US005111763A

United States Patent [19]

Moerbe

[11] Patent Number: 5,111,763

[45] Date of Patent: May 12, 1992

[54] STEERING UNIT FOR BARGES

[76] Inventor: Ronald C. Moerbe, 450 Honesuckle, Bridge City, Tex. 77611

[21] Appl. No.: 370,766

[22] Filed: Jun. 23, 1989

[51] Int. Cl.[5] ..... B63B 21/56

[52] U.S. Cl. ..... 114/246; 114/61; 440/70

[58] Field of Search ..... 440/66-72, 440/33, 38, 43, 46; 114/56, 61, 63, 162, 242, 246, 249, 251

[56] References Cited

U.S. PATENT DOCUMENTS

| | | | |
|---|---|---|---|
| D. 87,263 | 4/1932 | Johnson | D71/1 |
| D. 199,341 | 10/1964 | Bodiford | D71/1 |
| D. 200,885 | 4/1965 | Holtgrewe | D71/1 |
| D. 201,407 | 6/1965 | Miller | D71/1 |
| D. 232,425 | 8/1974 | Marriner | D15/4 |
| D. 238,418 | 1/1976 | Chung et al. | D12/6 |
| D. 290,351 | 6/1987 | Caddick | D12/300 |
| 1,023,699 | 4/1912 | Wilk | 440/69 |
| 1,163,075 | 12/1915 | Fowler | 440/70 |
| 1,838,335 | 12/1931 | Taylor | 440/69 |
| 2,899,925 | 8/1959 | Meek | 114/61 X |
| 4,315,476 | 2/1982 | van der Tak | 114/246 X |

FOREIGN PATENT DOCUMENTS

| | | | |
|---|---|---|---|
| 899912 | 11/1953 | Fed. Rep. of Germany | 440/70 |
| 2305781 | 8/1974 | Fed. Rep. of Germany | 114/249 |
| 3149618 | 7/1983 | Fed. Rep. of Germany | 440/68 |

*Primary Examiner*—Joseph F. Peters, Jr.
*Assistant Examiner*—Edwin L. Swinehart
*Attorney, Agent, or Firm*—Dodge, Bush & Moseley

[57] ABSTRACT

A steering unit (10) for a barge tow (12). The steering unit (10) has a hull (16) which includes a pair of spaced longitudinally extending portions (50, 52) and defining a cavity or tunnel (54) therebetween. A propeller (48) and rudder (36) are mounted within the cavity (54). Rear flaring side portions (74) define the cavity (54) adjacent the rudder (36) and the rudder (36) is movable between contact positions against opposed side portions (74) for exerting a maximum side thrust.

12 Claims, 2 Drawing Sheets

FIG. 1
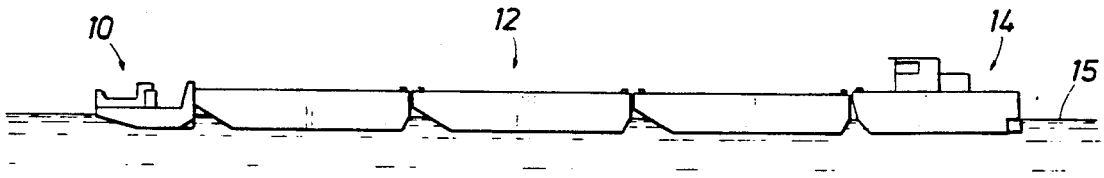
FIG. 2
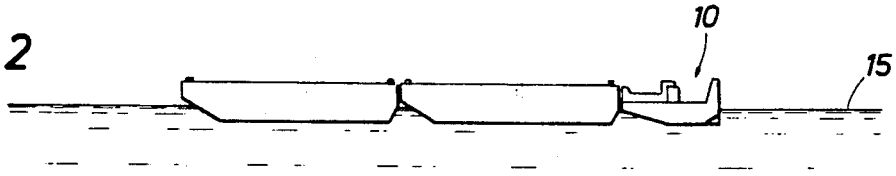
FIG. 3
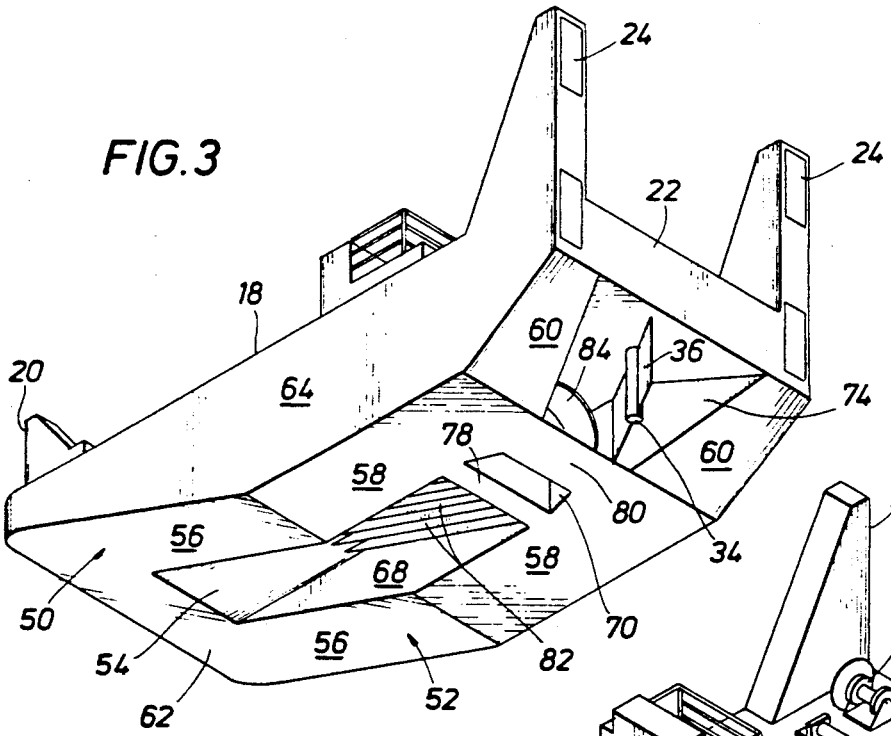
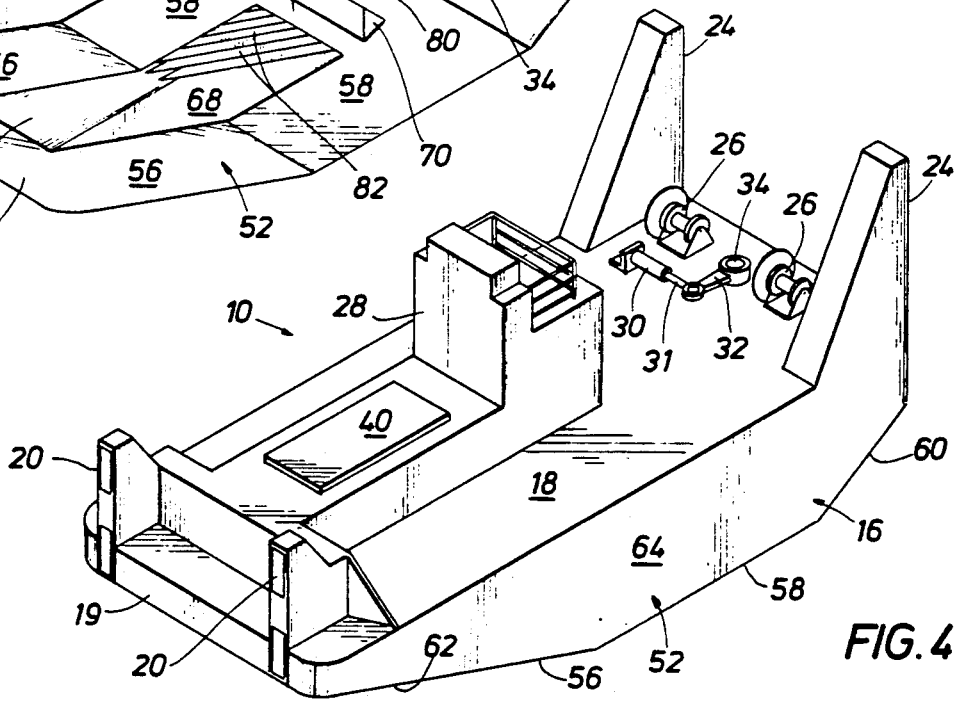
FIG. 4

FIG. 5
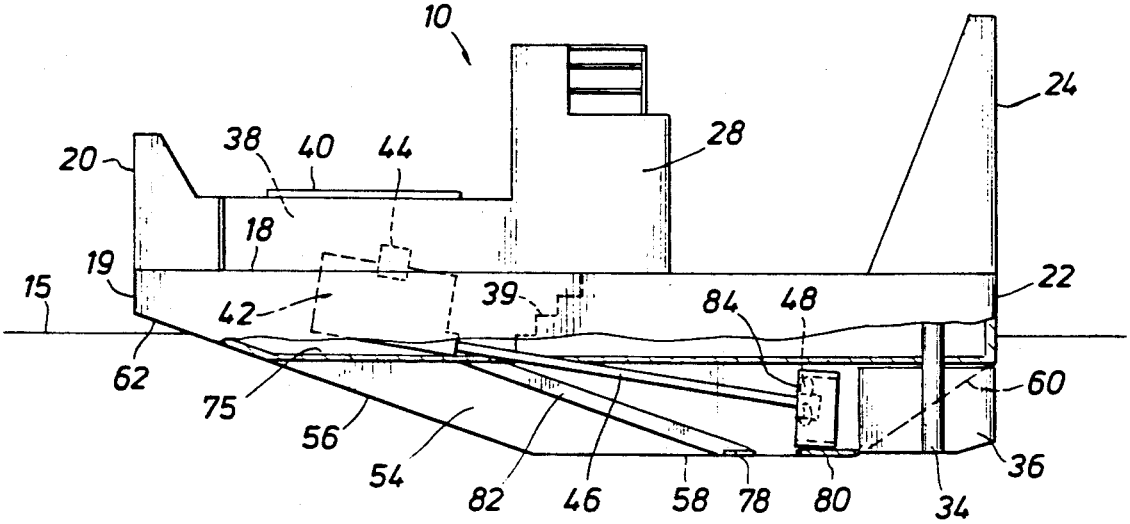
FIG. 6
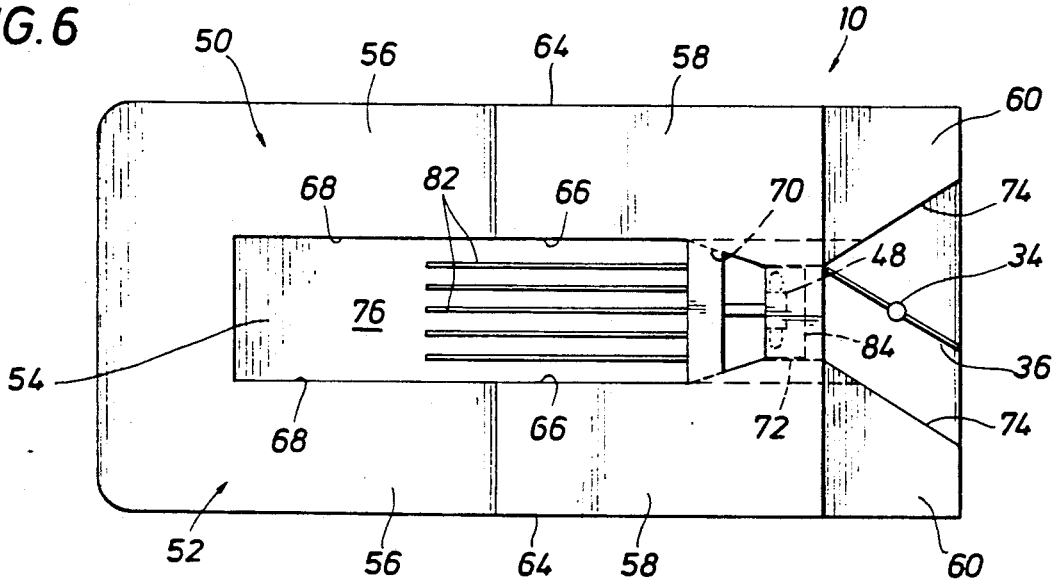
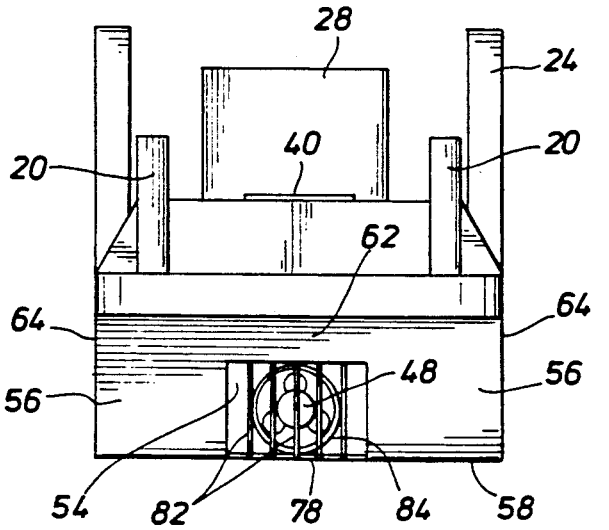
FIG. 7

STEERING UNIT FOR BARGES

BACKGROUND OF THE INVENTION

This invention relates to a steering unit for barges, and more particularly to a steering unit adapted to he attached to the front end of a string of barges on a waterway for directing or steering the barges along the waterway.

A string of barges or a barge tow normally consists of a plurality of barges connected end to end and pushed along a waterway by a tug boat. To aid in steering or directing the barge two along the waterway, a steering unit has been used heretofore connected to the front end of the barge tow and adapted to exert a lateral or side to side thrust for changing the course of direction of the barges in a minimum of time. Such steering units have been desirable for reducing groundings, collisions, and down time resulting from heavy winds or cross currents.

Also, it has been common heretofore to provide boats, such as catamarans with twin hull sections, or a hull having a longitudinally extending center cavity with a rudder mounted in the cavity for steering or guiding the boat. However, steering units for barges normally have not been provided with a hull having a longitudinally extending center cavity.

SUMMARY OF THE INVENTION

The present invention is particularly directed to a steering unit adapted to be attached to the front end of a barge tow or string of barges for steering the barge tow along a waterway as the barge tow is pushed by a tug boat. While the steering unit is normally utilized with a barge tow, the steering unit may if desired, be operated independently as a shift boat, or to hold a barge while other barges are being shifted by the tug boat or pusher.

The steering unit comprises a hull formed of a pair of spaced longitudinally extending side portion defining a longitudinally extending cavity or tunnel therebetween for the flow of water, a rudder mounted in the cavity for pivotal movement adjacent the stern of the steering unit, and a propeller mounted in the cavity adjacent and forward of the rudder. The cavity is defined between a pair of generally vertically extending spaced side surfaces connected at their upper edges by a laterally extending surface to define the upper portion of the cavity, and the cavity directs the flow of water to the propeller. Such an arrangement results in increased speed and control for the barge tow.

The bottom of the hull of the steering unit is formed of connecting planar surfaces with front planar surfaces sloping downwardly from the bow of the steering unit at a relatively gradual slope of around 18° and extending for over a third of the length of the steering unit. Such an arrangement provides a minimal drag. Aklso, a direct drive inclined shaft is connected to the propeller and an engine for rotating the shaft is positioned at a location above the water line of the steering unit.

It is an object of this invention to provide a steering unit for connecting to the front end of a barge tow for steering the barge tow with increased speed and control.

It is a further object of this invention to provide such a steering unit with a center cavity extending longitudinally of the hull in which a rudder and propeller are mounted for controlling the direction of the barge tow along a waterway.

A further object of this invention is the provision of such a steering unit in which the bottom of the cavity beneath the propeller is closed and the side surfaces of the cavity adjacent and forward of the propeller converge toward the propeller thereby to provide an increased flow of water to the propeller for increased propulsion and protection for the propeller and rudder.

DESCRIPTION OF THE INVENTION

Other objects and advantages appear from the following description and drawings, wherein:

FIG. 1 is diagrammatic side elevation illustrating the steering unit comprising the present invention attached to the front end of a barge tow with a tug boat at the rear end;

FIG. 2 is a further diagrammatic side elevation illustrating the steering unit shown in FIG. 1 at the rear end of a pair of barges for shifting the barges;

FIG. 3 is a bottom perspective of the steering unit shown in FIGS. 1 and 2 and illustrates the longitudinally extending cavity in the hull in which the rudder and propeller are mounted;

FIG. 4 is a top perspective of the steering unit shown in FIG. 3 showing the deck and deck house;

FIG. 5 is a side elevation with portions of the steering unit broken away and shown in section;

FIG. 6 is a bottom plan of the steering unit; and

FIG. 7 is a front elevation of the steering unit.

Referring now to the drawings for a better understanding of this invention, the steering unit comprising the present invention is shown generally at 10 attached to the front end of a barge tow or string of barges shown generally at 12. A tug boat 14 is shown at the rear end of barge tow 12 for pushing barge tow 12 along a waterway in which the water line is shown at 15. FIG. 2 illustrates steering unit 10 at the rear end of a pair of barges for shifting or holding the barges.

Steering unit 10 is of a generally rectangular shape in plan and includes a body or hull 16 having a deck 18. The bow or front end 19 of steering unit 10 has a pair of front stanchions 20 extending upwardly from deck 18 at opposed corners thereof for pushing a barge or the like. The stern or rear end 22 of steering unit 10 has a pair of rear stanchions 24 at opposed corners of deck 18 and extending upwardly therefrom for abutting contact with the adjacent front end of barge tow 12.

A pair of winches or windlasses shown at 26 may have suitable lines or cables wound thereon for securing steering unit 10 to barge tow 12, or to any other desired structures. Windlasses 26 may be either manually or power operated, as desired. A deck house 28 is provided for an operator and a steering wheel or controls (not shown) are provided in deck house 28 for actuation by the operator. A fluid operated cylinder 30 has a piston rod 31 connected to link 32 secured to a vertical axis 34 for controlling the movement of a rudder 36 secured to axis 34 as will be explained further.

An engine compartment shown generally at 38 has steps 39 leading from deck house 28 and a removable cover 40 provides access to compartment 38 from deck 18. An internal combustion engine illustrated generally at 42 is mounted within compartment 38 and an engine mounted hydraulic pump 44 provides fluid to cylinder 30 for pivoting of rudder 34 and steering of steering unit 10. A direct drive shaft 46 extends from engine 42 to a propeller 48 as will be explained further. Engine 42 is mounted within compartment 38 above the water line shown at 15 and shaft 46 extends in an angular direction to propeller 48. While an operator in deck house 28 normally controls the operation of steering unit 10, it is to be understood that steering unit 10 may be remotely controlled, if desired, by the use of suitable pneumatic or electric control devices (not shown) actuated from tug boat 14.

Referring now in more detail to the lower portion of hull 16 which forms an important part of this invention, hull 16 includes a pair of spaced lower portions 50 and 52 extending longitudinally in parallel spaced relation to each other and defining a longitudinally extending cavity or tunnel 54 therebetween. Each lower hull portion 50,52 has a plurality of lower connecting planar surfaces including a forward downwardly inclined front planar surface 56, a contiguous intermediate horizontal or flat surface 58, and a rear upwardly inclined planar surface 60. An inclined planar front end portion 62 extends across the entire width of steering unit 10 adjacent bow 19 and forms a smooth continuation of inclined front planar surfaces 56. The forward inclined planar surface formed by surfaces 56 and 62 is a gradual sloping surface around fifteen to twenty degrees (15° to 20°) with respect to the water level and extends about 40% of the entire length of steering unit 10 which along with cavity 54 tends to reduce the drag as steering unit 10 is pushed in front of barge tow 12.

Each hull portion 50, 52 has an outer generally vertical side 64, and an inner generally vertical side 66 defining a side of cavity 54. Each inner side 66 is formed of a plurality of connecting planar surfaces including a longitudinally extending front side surface 68, a converging inclined surface 70, a short length intermediate side surface 72, and a connecting diverging rear side surface portion 74. Hull 16 has a bottom 75 supporting engine 53 and defining a lower planar surface 76 extending between side portions 50 and 52 at their upper ends for forming the upper surface of cavity 54. Thus, cavity or tunnel 54 is of a uniform width between side portions 68 but converges to a smaller width between intermediate side portions 72. Then, cavity 54 flares outwardly at a relatively wide angle at diverging side surface portions 74 such as 35° from intermediate side portions 72. However, under certain conditions, side surface portions 74 may function effectively if diverging only around 20° from intermediate side portions 72.

Extending between hull side portions 50 and 52 across the bottom of cavity 54 at adjacent ends of converging side surfaces 70 are a pair of connecting reinforcing members 78 and 80. A plurality of spaced vertically extending guards 82 extend downwardly from bottom 75 within cavity 54 and are supported on connecting member 78. The flat bar guards protect the propeller from damage by logs and other debris in the water.

Mounted within cavity 54 over connecting member 80 is a propeller housing 84 defining a circular opening therein in which propeller 48 is mounted. Rudder shaft 34 and rudder 36 secured thereto are mounted within cavity 54 rearwardly of propeller 48. Rudder 36 may be pivoted between contact positions against diverging side surfaces 74 and is of substantially the same height as the depth of cavity 54. Thus, rudder 36 may completely block one side of cavity 54 to exert the entire thrust of steering unit 10 to a desired side. Also, steering unit 10 can exert thrust in a rearward direction to assist the barge tow against water currents, or it may reverse and exert a thrust in a forward direction for reducing the speed of the barge tow.

Steering unit 10 is a versatile unit as it can be operated independently, such as might be desirable for taking individual barges through a lock, or for holding selected barges against a bank while other barges are shifted to different locations.

While the drawings illustrate only a single propeller for the steering unit, it is to be understood that twin propellers may be used, if desired. The engine is mounted above the water line and is easily accessible for repair upon removal of cover 40. The location of the engine above the water line minimizes any damage resulting from leaking shaft bearings. The propeller and rudder are protected since mounted within cavity 54 between hull side portions 50 and 52.

While a preferred embodiment of the present invention has been illustrated in detail, it is apparent that modifications and adaptations of the preferred embodiment may occur to those skilled in the art. However, it is to be expressly understood that such modifications and adaptations are within the spirit and scope of the present invention as set forth in the following claims.

What is claimed is:

1. A barge steering unit adapted to be attached to the front end of a string of connected barges pushed by a boat for steering the string of barges along a waterway; said barge steering unit comprising:

an elongate water buoyant body of a generally rectangular shape in plan and having a hull with a bow and a stern, said hull formed of a pair of longitudinally extending side portions spaced from each other to define a longitudinally extending cavity therebetween for the flow of water therethrough from said bow to said stern, said cavity defined by a pair of generally vertically extending spaced side surfaces connected at their upper edges by a generally horizontal planar surface to define the upper portion of the cavity and the bottom of the hull;

each of said side portions of said hull having a forward included planar surface and an intermediate planar surface, said forward surface extending downwardly from adjacent said bow to said intermediate surface for at least one third of the length of said unit to reduce drag;

a propeller mounted in said cavity for contact with the water flowing through the cavity to propel said barge steering unit;

said pair of spaced side surfaces defining surface portions diverging outwardly from adjacent said propeller to said stern of the barge steering unit;

power means for rotating said propeller to propel said steering unit;

a rudder means mounted in said cavity rearwardly of said propeller for pivotal movement for guiding the movement of said steering unit, said rudder is of a height substantially the depth of the cavity;

said rudder mounted for pivotal movement between a position engaging one of said diverging rear side surface portions and a position engaging the other of said diverging rear side surface portions, said rudder when positioned against a selected side portion of the cavity substantially blocking the flow of water along such selected side portion for directing the thrust along a desired direction; and means for pivoting said rudder to a desired angle relative to the flow of water through the cavity for steering said unit and the string of barges connected thereto along the waterway.

2. The barge steering unit as set forth in claim 1 wherein each of said side portions of said hull further includes a rear planar surface sloping upwardly from said intermediate planar surface to the stern of said steering unit.

3. The barge steering unit as set forth in claim 1 wherein said rear side surface portions diverge outwardly from the longitudinal axis of the unit at an angle over around twenty degrees.

4. The barge steering unit as set forth in claim 1 wherein the width of said cavity is reduced forward of said propeller for funneling the flow of water to the propeller.

5. The barge steering unit as set forth in claim 1 wherein a plurality of spaced longitudinally extending generally parallel guards are mounted in said cavity forwardly of said propeller to protect the propeller.

6. The barge steering unit as set forth in claim 1 wherein said power means for rotating said propeller includes a drive shaft connected to said propeller and extending therefrom in an inclined direction to a position above the normal water line of the barge steering unit, and an internal combustion engine mounted above the water line of the barge steering unit connected to said direct drive shaft for rotating said propeller.

7. The barge steering unit as set forth in claim 1 wherein said cavity having a housing disposed therein, said housing having a generally circular opening to receive the propeller mounted in said cavity.

8. A barge steering unit adapted for attachment to the front end of a string of barges for steering the barges along a waterway; said barge steering unit comprising:

an elongated water buoyant body of a generally rectangular shape in plan and having a hull with a bow, a stern and a deck, said hull formed of a pair of longitudinally extending side portions spaced from each other to define a longitudinally extending cavity therebetween for the flow of water therethrough between said bow and said stern, said cavity having an intermediate reduced width portion and an outwardly flared portion extending from said intermediate reduced width portion to said stern;

each of said side portions of said hull having a forward inclined planar surface and an intermediate planar surface, said forward surface extending downwardly from adjacent said bow to said intermediate surface for at least one third of the length of said unit to reduce drag;

first stanchion means mounted on said stern of said steering unit for contacting the front end of the string of barges;

a propeller mounted in said cavity adjacent said intermediate reduced width portion for contact with the water flowing through the cavity;

a rudder pivotally mounted in the flaring portion of said cavity for contact with water flowing through said cavity for guiding the movement of the unit along the waterway;

power means for rotating said propeller to propel said steering unit; and means for pivoting said rudder to a desired angle relative to the flow of water through the cavity for steering said unit and the string of barges connected thereto along the waterway.

9. The barge steering unit as set forth in claim 8 wherein said rudder is mounted for pivotal movement between a position engaging one of said diverging rear side surface portions and a position engaging the other of said diverging rear side surface portions, said rudder when against a selected side surface portion of the cavity blocking the flow of water along such selected side portion for directing the thrust along a desired direction.

10. The barge steering unit as set forth in claim 9 wherein said rudder is of a height substantially the same as the height of the cavity.

11. The barge steering unit as set forth in claim 8 wherein said outwardly flared portions diverge outwardly from the longitudinal axis of the unit at an angle over around twenty degrees.

12. The barge steering unit as set forth in claim 8, including second stanchion means mounted on said bow of said steering unit for pushing a barge.

* * * * *